US009926173B1

(12) United States Patent
Strieter

(10) Patent No.: US 9,926,173 B1
(45) Date of Patent: Mar. 27, 2018

(54) ROBOTIC STEP TRANSFER SYSTEM FOR CONNECTING ASCENDING AND DESCENDING SPIRAL ESCALATOR STEPS

(71) Applicant: John Richard Strieter, Rock Island, IL (US)

(72) Inventor: John Richard Strieter, Rock Island, IL (US)

(73) Assignee: John Richard Strieter, Rock Island, IL (US)

( * ) Notice: Subject to any disclaimer, the term of this patent is extended or adjusted under 35 U.S.C. 154(b) by 0 days.

(21) Appl. No.: 15/632,103

(22) Filed: Jun. 23, 2017

(51) Int. Cl.
*B66B 21/06* (2006.01)
*B66B 23/12* (2006.01)
*B66B 23/02* (2006.01)

(52) U.S. Cl.
CPC ..... *B66B 21/06* (2013.01); *B66B 23/12* (2013.01); *B66B 23/02* (2013.01)

(58) Field of Classification Search
CPC ..... B66B 21/06; B66B 23/12
USPC ..... 198/321, 326, 328, 333
See application file for complete search history.

(56) References Cited

U.S. PATENT DOCUMENTS 723,325 A * 3/1903 Souder ..... B65G 21/18 198/327
889,080 A * 5/1908 Wheeler ..... B66B 21/06 198/328
967,710 A * 8/1910 Bennett ..... B66B 21/06 198/323
984,495 A * 2/1911 Seeberger ..... B66B 21/06 198/328
999,885 A * 8/1911 Seeberger ..... B66B 21/06 198/328
3,878,931 A * 4/1975 Luna ..... B66B 21/06 198/328
4,411,352 A * 10/1983 Kettle ..... B66B 21/08 198/328
4,434,884 A * 3/1984 Kettle ..... B65G 21/18 198/328
5,009,302 A * 4/1991 Sansevero ..... B66B 21/06 198/328
5,052,539 A * 10/1991 Fillingsness ..... B66B 21/06 198/323
5,158,167 A * 10/1992 Pahl ..... B66B 21/06 198/328
6,899,216 B2 * 5/2005 Levy ..... B66B 21/06 198/328
9,550,654 B2 * 1/2017 Bavafa ..... B66B 21/06
2016/0368740 A1 * 12/2016 Bavafa

* cited by examiner

*Primary Examiner* — Douglas A Hess

(57) ABSTRACT

This invention provides a circular tower spiral escalator structure with counter-rotating sprocket wheels at the top and bottom floors that use a side bow roller chain to connect and drive the ascending and descending escalator steps. Two pedestal robots and a step conveyor at the top and bottom floors pick up each escalator step when it arrives and move it to the opposite side of the circular tower where it departs. An alternate design replaces the two pedestal robots and step conveyor with a double arm pedestal robot on the top and bottom floors. Both designs provide continuous transport of escalator riders to a plurality of floors of varying ceiling heights with level entries and exits on each floor.

4 Claims, 11 Drawing Sheets

ROBOTIC STEP TRANSFER SYSTEM FOR CONNECTING ASCENDING AND DESCENDING SPIRAL ESCALATOR STEPS

BACKGROUND OF THE INVENTION

For many centuries spiral stairs have been a fascination for architects, designers, builders and owners. Even more fascination occurred when the spiral design encompassed single supports either on the exterior wall or on an interior column. As strength of materials improved, construction designs provided for supports at the base and the floor above. The greater the ceiling height the more complex and spectacular the designs became.

Compared with elevators, straight-line escalators serving one floor at a time in both directions became an improvement in rider movement where less than a dozen floors were involved.

Next came the transition from straight to curved and even spiral escalators. The preference for spiral escalators became popular since the design requires less horizontal space than straight escalators, especially where there are variations of ceiling height. A spiral escalator was constructed at London's Holloway Road underground station in 1906 only to be dismantled almost immediately. The Mitsubishi Electric Corporation has successfully developed commercial designs and has manufactured curved and spiral escalators since the 1980s.

All of the current designs are limited to serve only one pair of floors at a time. Separate escalators are required for ascending or descending installations and are usually constructed side by side, requiring a large horizontal space. Only half of the steps are in use at any time for all escalators, due to the continuous travel requiring the returning steps passing under the conveyor. This results in having steps in use only half of the time.

Ever since 1883 when the first escalator (called "inclined elevator") was invented, the escalator has been a favorite means for mass transportation of riders in preference to vertical elevators. Through the years many inventions have been processed that attempted to improve the straight line escalators by: making more efficient use of the horizontal space required, serving multiple floors without requiring the riders to leave and re-enter at each floor, using all steps all of the time, utilizing large vertical space, improving the aesthetics and architecture, and increasing rider movement more economically and efficiently.

This invention achieves all of these aspirations by providing a circular tower spiral escalator structure with counter-rotating sprocket wheels that use a chain to connect and drive the ascending and descending escalator steps. Also, this invention provides at the top and bottom floors, robotic transfer of the escalator steps between the sets of ascending and descending steps. This eliminates the necessity for the upside down empty return of the steps underneath those steps that are bearing a load. For a given installation, this reduces the total number of steps, tracks and chains by about half.

BRIEF SUMMARY OF THE INVENTION

The robotic step transfer system provides a circular tower spiral escalator structure with counter-rotating sprocket wheels on the top and bottom floors that use a side bow roller chain to drive the ascending and descending escalator steps. On the top and bottom floors, a pedestal robot picks up each step when it arrives. The robot pivots and deposits the step at the end of a moving step conveyor. At the other end of the conveyor, another pedestal robot picks up the next step at that end, pivots, and deposits the step on the other side of the tower where it departs and descends to the next floor below. When each step arrives at the top floor, its vertical riser is on the trailing edge of its tread. When each step is deposited on the other side of the tower, it has been turned so that the riser is on the leading edge of its tread, which it must be.

An alternate design replaces the two pedestal robots and the step conveyor with a double arm pedestal robot on the top and bottom floors.

Both designs provide continuous transport of escalator riders to a plurality of floors of varying ceiling heights with level entries and exits on each floor.

BRIEF DESCRIPTIONS OF THE DRAWINGS

FIG. 1 is the axonometric view of the entire circular tower spiral escalator structure. Counter-rotating sprocket wheels on the top floor drive the ascending and descending escalator steps by means of a side bow roller drive chain that is attached to the steps. On the top floor, a pedestal robot picks up each escalator step when it arrives. A horizontal step conveyor is in position to transport the unattached steps from one side of the tower to the other. The pedestal robot rotates as it carries the step and places it on the end of the conveyor. At the other end of the conveyor, a second pedestal robot picks up the next step from the conveyor. This robot rotates as it carries the step and places it at the beginning of the set of descending escalator steps. A duplicate set of equipment to that located on the top floor of the tower is installed on the bottom floor.

Figure 5:
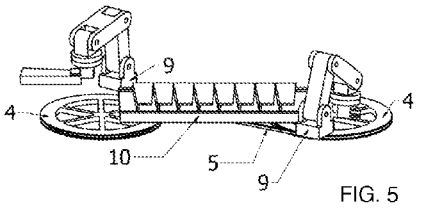

FIG. 5 shows an axonometric view on the top floor where the pedestal robot on the left has just picked up an escalator step from the top end of the set of ascending escalator steps. Call this time t=0. The step conveyor shows eight steps that are moving to the right. The pedestal robot on the right is moving into position for a pickup.

Figure 6:
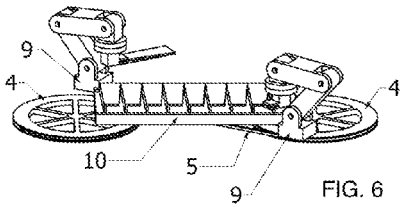

FIG. 6 shows an axonometric view on the top floor with both robots at a later time t=3. A total of nine time intervals define the complete cycle of moving the steps. Here at t=3 the robot on the left is turning a step so it will exactly fit on the conveyor when it arrives at t=4. The robot on the right continues to move into position to pick up a step from the right-hand end of the conveyor which it will do at t=4.

Figure 7:
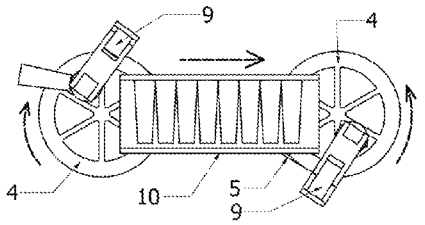

FIG. 7 shows the top view of FIG. 5, time t=0.

Figure 8:
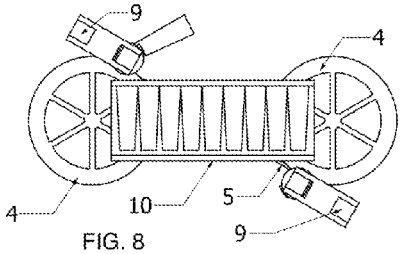

FIG. 8 shows the top view of FIG. 6, time t=3.

Figure 9:
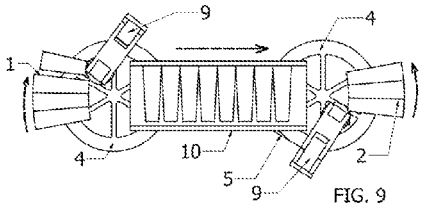

FIG. 9 corresponds to FIG. 7 at time t=0 with the addition of three escalator steps on each side that are part of the moving escalator steps. These steps are moving horizontally, parallel to and in the same plane as the top floor. The three on the left have just arrived from the floor below. The three on the right are on the way down to the floor below.

Figure 10:
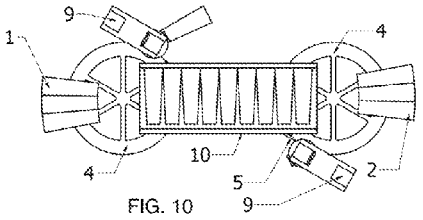

FIG. 10 corresponds to FIG. 8 at time t=3 with the addition of the six steps described in FIG. 9.

Figure 11:
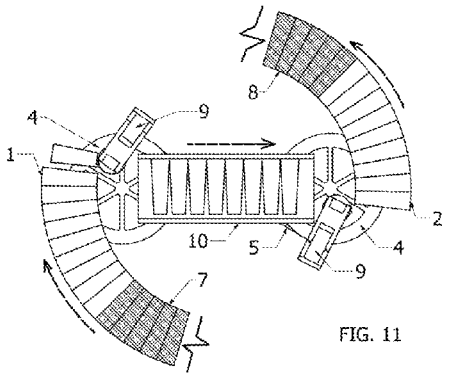

FIG. 11 corresponds to FIG. 9 at time t=0 with the addition of more moving escalator steps on each side. The crosshatched steps on the left are ascending from the floor below and those on the right are descending to the floor below.

Figure 12:
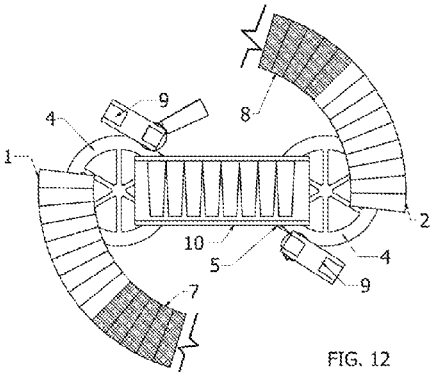

FIG. 12 corresponds to FIG. 10 at time t=3 with the addition of the ascending and descending escalator steps described in FIG. 11.

Figure 13:
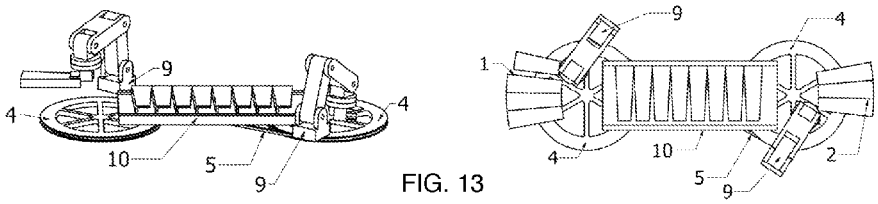

FIG. 13 shows the view on the top floor at time t=0. The left side is identical to FIG. 5 and the right side is identical to FIG. 9. This represents the beginning of the nine time intervals of the cycle that in essence moves a single step from one side of the tower to the other.

Figure 14:
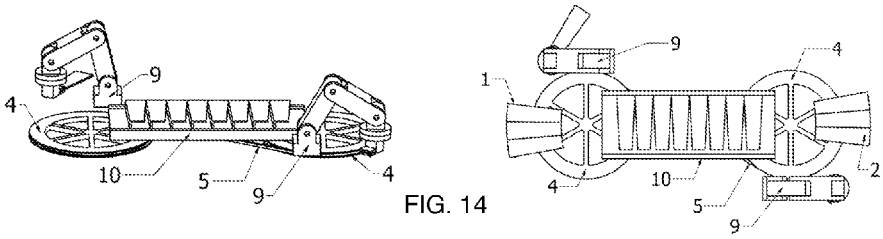

FIG. 14 shows the configuration at a later time t=1. Both robots have moved and changed their orientation. The left robot is carrying a step while the right robot is not.

Figure 15:
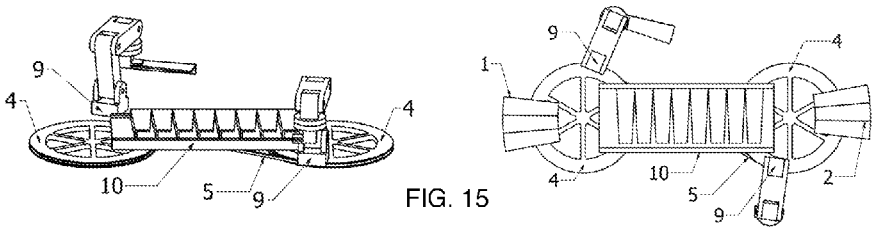

FIG. 15 shows the configuration at t=2. In effect, this is the third frame of a movie depicting the activity of both robots and the conveyor.

Figure 16:
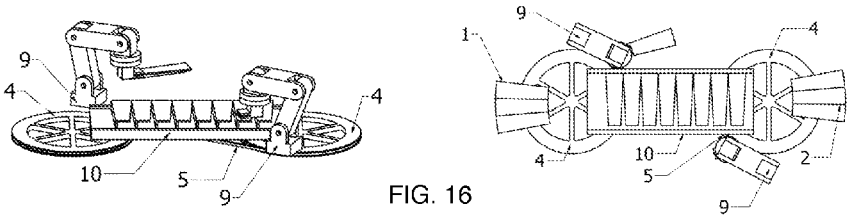

FIG. 16 shows the configuration at t=3, the fourth frame of the movie. The eight steps on the conveyor continue to move to the right.

Figure 17:
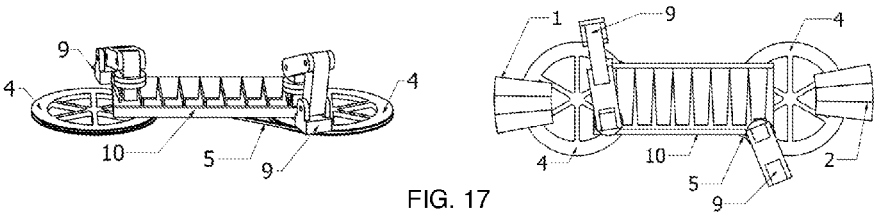

FIG. 17 shows the configuration at t=4, the fifth frame of the movie. This is at the midpoint of the activity with the left robot placing a step on the left end of the conveyor while the right robot is simultaneously grabbing a step on the right end of the conveyor.

Figure 18:
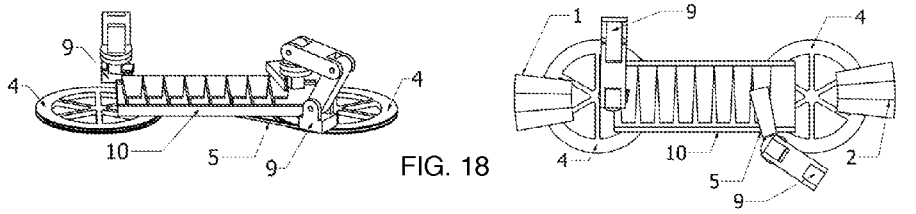

FIG. 18 shows the configuration at t=5, the sixth frame of the movie. The left robot is starting its journey back to the beginning while the right robot is in the process of carrying a step to the right side of the tower.

Figure 19:
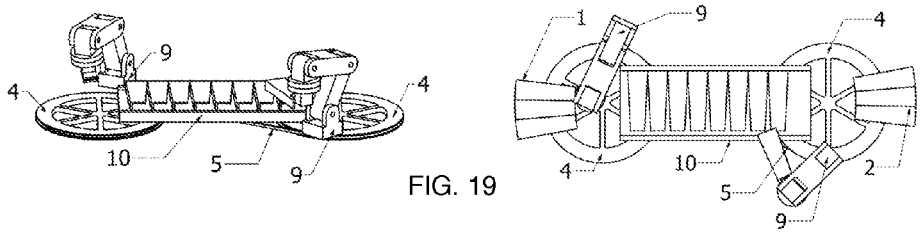

FIG. 19 shows the configuration at t=6, the seventh frame of the movie.

Figure 20:
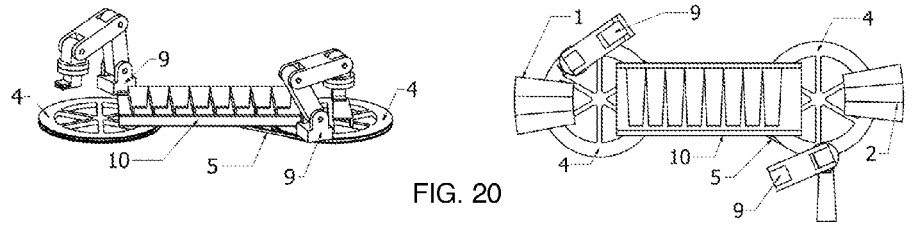

FIG. 20 shows the configuration at t=7, the eight frame of the movie.

Figure 21:
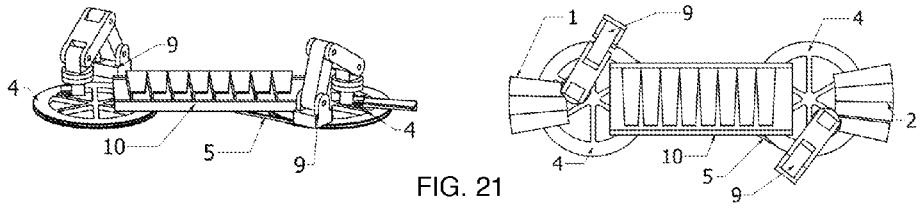

FIG. 21 shows the configuration at t=8, the ninth frame of the movie. The right robot is placing a step on the set of descending escalator steps that are on their way down to the lower floor.

Figure 22:
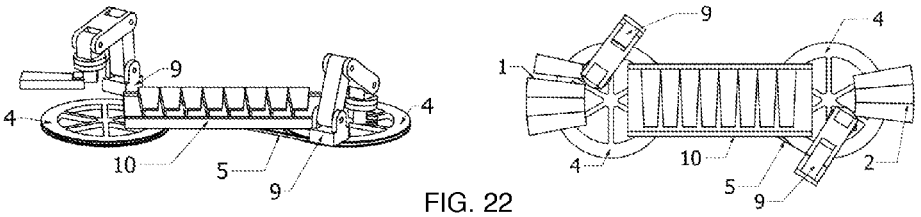

FIG. 22 shows the configuration at t=9, the tenth and final frame of the movie. This frame is identical to the beginning of the cycle shown in FIG. 13, the first frame of the movie.

Figure 23:
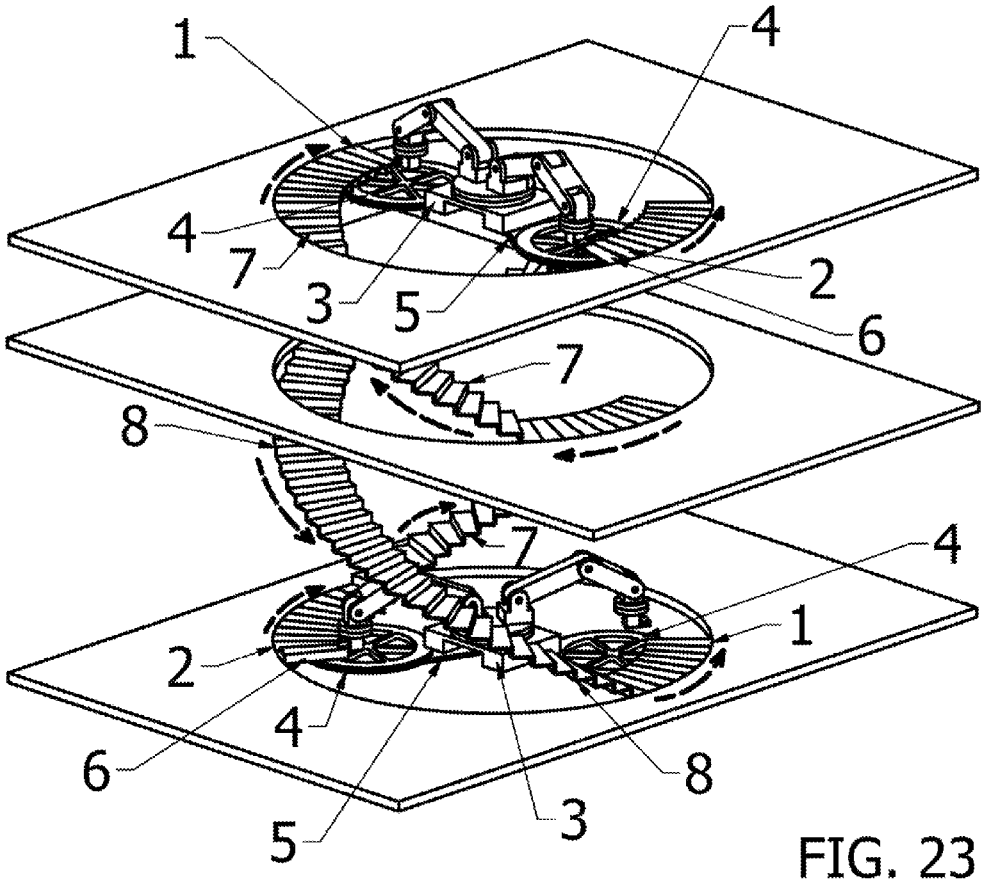

FIG. 23 is the axonometric view of the entire circular tower spiral escalator structure depicting the alternate design of the robotic step transfer system. Counter-rotating sprocket wheels at the top floor drive the ascending and descending escalator steps by means of a side bow roller drive chain. One arm of a double arm pedestal robot on the top floor picks up an escalator step when it arrives. The robot rotates and carries the step to the other side of the tower where it places it at the beginning of the set of descending escalator steps. Meanwhile, the other arm of the double arm robot has lowered and released a previous escalator step as it then rotates to move into position to pick up the next step from the set of ascending escalator steps. A duplicate set of equipment to that located on the top floor of the tower is installed on the bottom floor.

Figure 24:
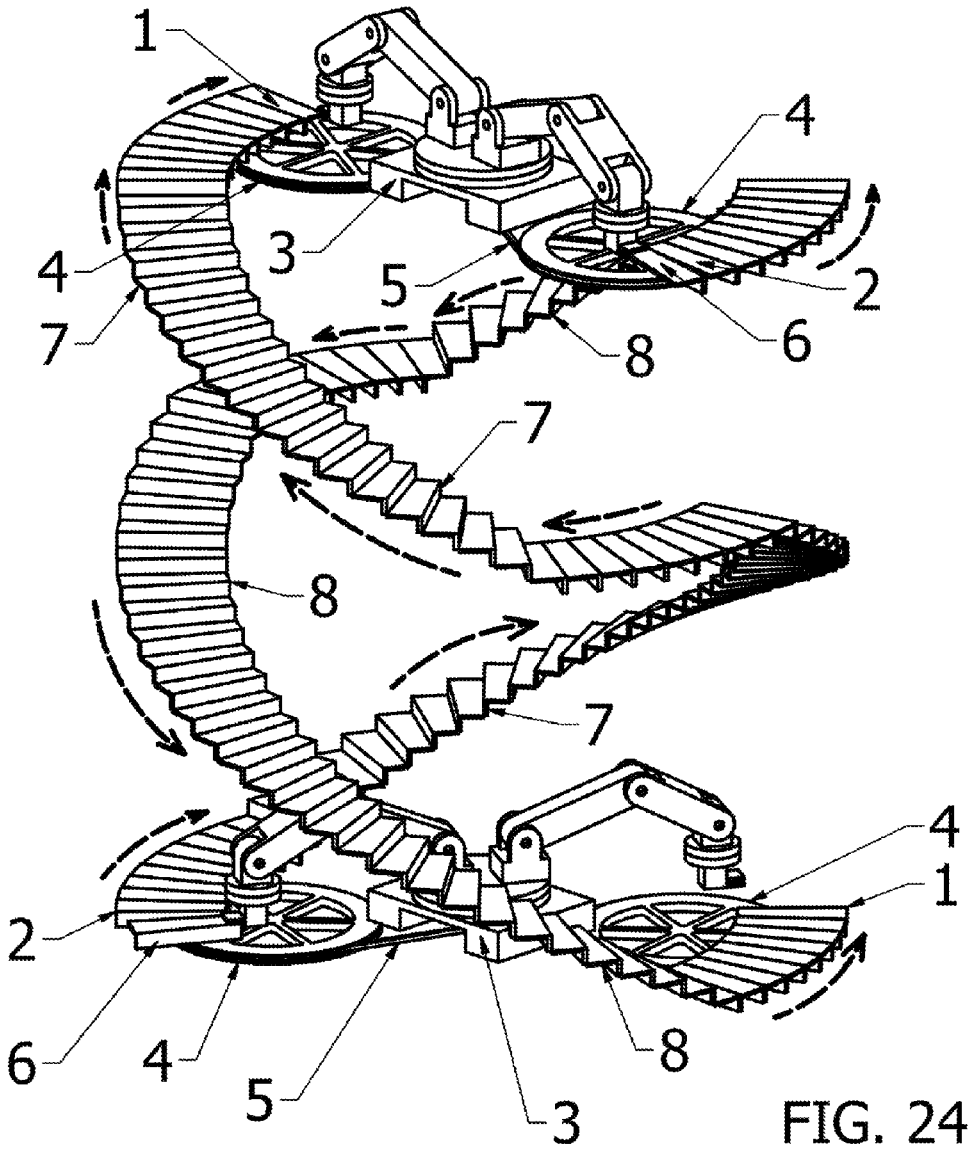

FIG. 24 is the axonometric view of the circular tower spiral escalator structure depicting the alternate design of the robotic step transfer system. The three floors have been omitted to make it easier to view the escalator steps, robots, and sprocket wheels.

Figure 25:
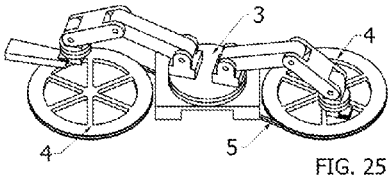

FIG. 25 shows an axonometric view of the alternate design on the top floor where the robot arm on the left has just picked up a step from the left side of the tower. Call this time t=0. The robot arm on the right has an empty hand as it begins its journey to the left side.

Figure 26:
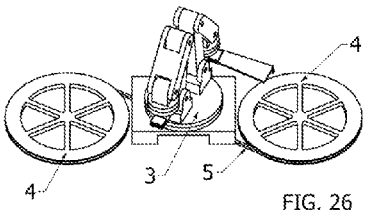

FIG. 26 shows an axonometric view of the alternate design with the robot at a later time t=3. A total of nine time intervals define the complete cycle of moving a step from one side of the tower to the other. Here at t=3 the robot arm on the backside is turning the step as it moves toward its destination on the right side of the tower. The robot arm on the front side continues to move into position to pick up a step from the left side of the tower.

Figure 27:
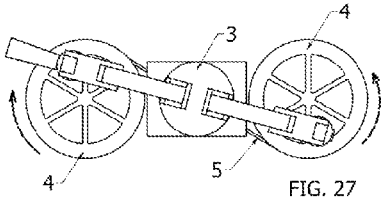

FIG. 27 shows the top view of FIG. 25, time t=0.

Figure 28:
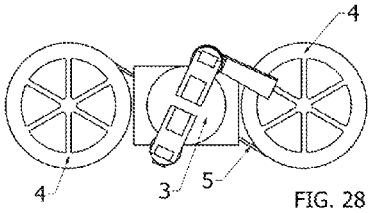

FIG. 28 shows the top view of FIG. 26, time t=3.

Figure 29:
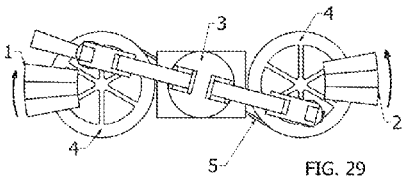

FIG. 29 corresponds to FIG. 27 at time t=0 with the addition of three steps on each side that are part of the moving escalator steps. These steps are moving horizontally, parallel to and in the same plane as the top floor. The three steps on the left have just arrived from the floor below. The three on the right are on the way down to the floor below.

Figure 30:
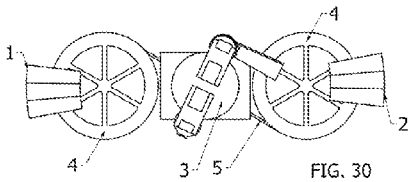

FIG. 30 corresponds to FIG. 28 at time t=3 with the addition of the six steps described in FIG. 29.

Figure 31:
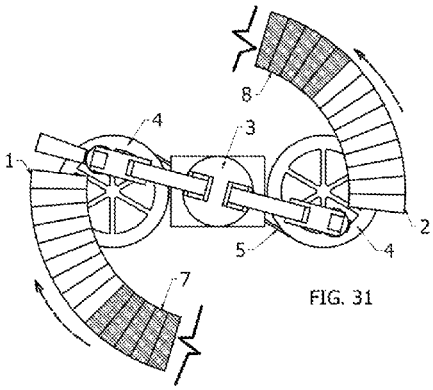

FIG. 31 corresponds to FIG. 29 at time t=0 with the addition of more moving escalator steps on each side. The additional steps on the left are ascending from the floor below and those on the right are descending to the floor below.

Figure 32:
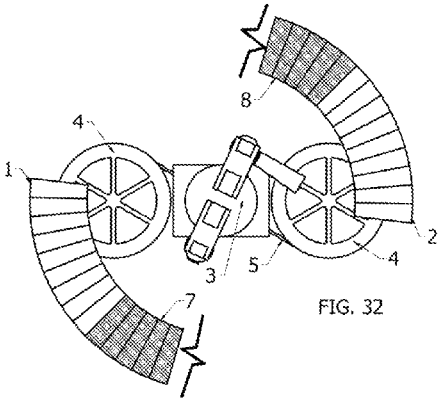

FIG. 32 corresponds to FIG. 30 at time t=3 with the addition of the ascending and descending escalator steps described in FIG. 31.

Figure 33:
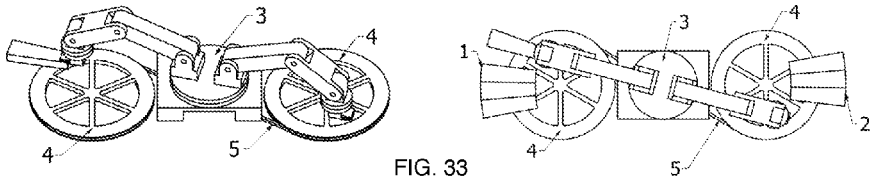

FIG. 33 shows the alternate design at time t=0. The drawing on the left side is identical to FIG. 25 and the drawing on the right side is identical to FIG. 29. This represents the beginning of the nine time intervals of the cycle that moves a single step from one side of the tower to the other.

Figure 34:
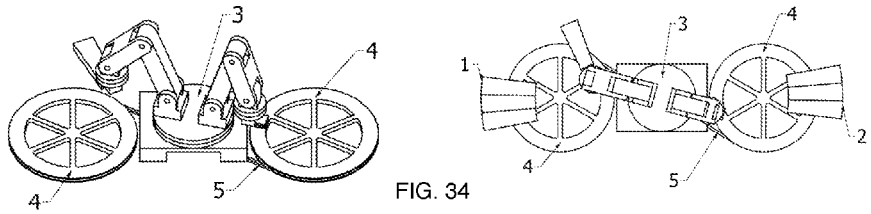

FIG. 34 shows the alternate design at a later time t=1. Both arms of the robot have moved and changed their orientation. The back arm is carrying a step while the front arm is not.

Figure 35:
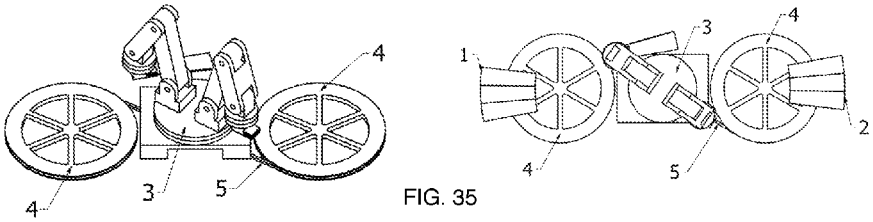

FIG. 35 shows the alternate design at t=2. In effect, this is the third frame of a movie depicting the activity of the robot.

Figure 36:
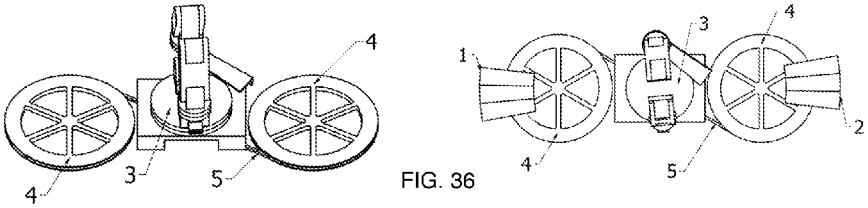

FIG. 36 shows the alternate design at t=3, the fourth frame of the movie.

Figure 37:
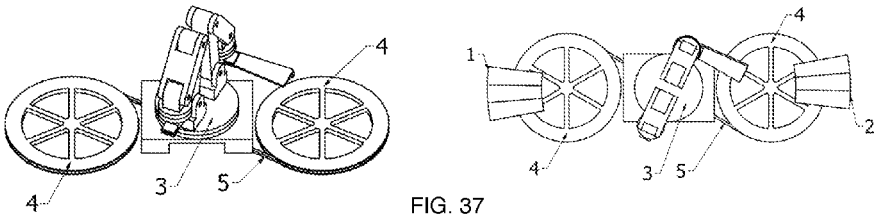

FIG. 37 shows the alternate design at t=4, the fifth frame of the movie. This is at the midpoint of the activity.

Figure 38:
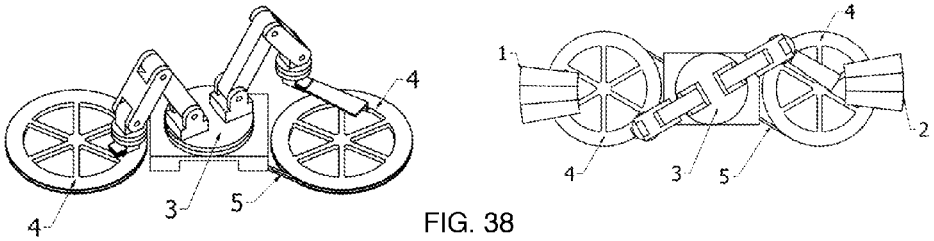

FIG. 38 shows the alternate design at t=5, the sixth frame of the movie.

Figure 39:
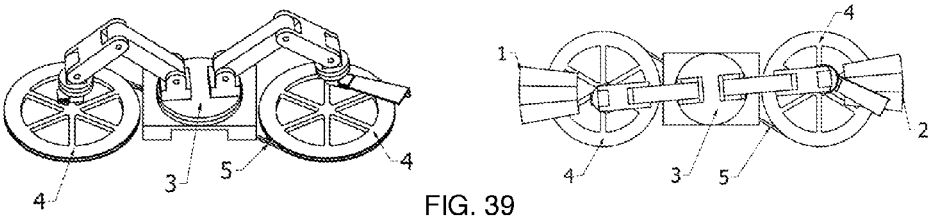

FIG. 39 shows the alternate design at t=6, the seventh frame of the movie.

Figure 40:
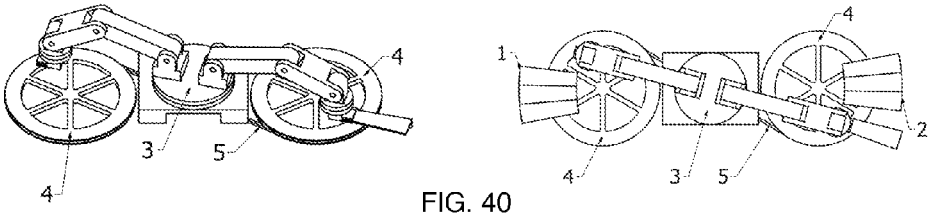

FIG. 40 shows the alternate design at t=7, the eighth frame of the movie.

Figure 41:
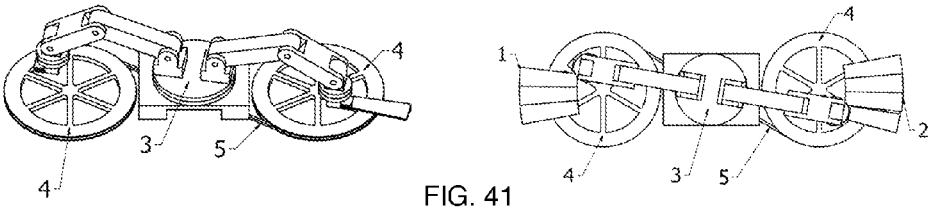

FIG. 41 shows the alternate design at t=8, the ninth frame of the movie. The robot is placing a step on the part of the escalator that is on its way down to the lower floor.

Figure 42:
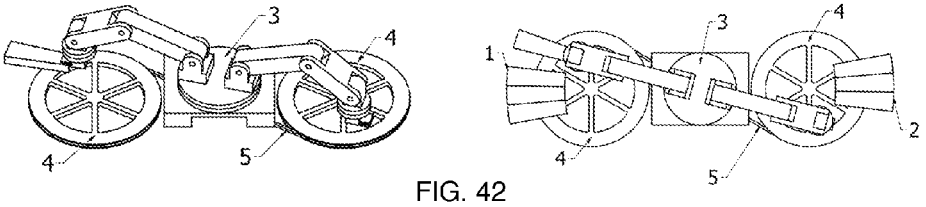

FIG. 42 shows the alternate design at t=9, the tenth and final frame of the movie. This frame is identical to the first frame at the beginning of the cycle shown in FIG. 33.

DETAILED DESCRIPTION OF THE INVENTION

Figure 1:
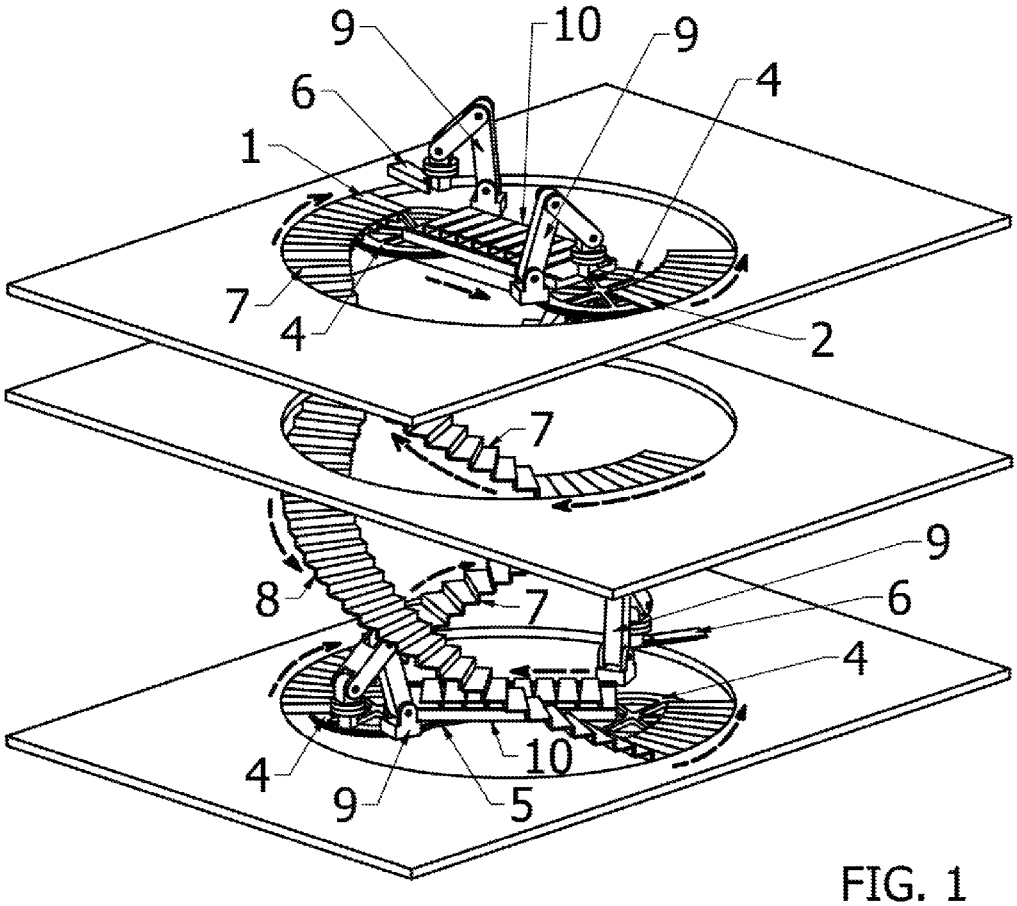

FIG. 1 is the axonometric view of the entire circular tower spiral escalator structure. Counter-rotating sprocket wheels 4 on the top floor drive the ascending and descending escalator steps by means of a side bow roller drive chain 5 that is attached to the steps. As ascending steps 7 arrive at the top floor, a pedestal robot 9 picks up a step 1 having thereby disengaged it from the drive chain. A horizontal step conveyor 10 is in position to transfer the unattached escalator steps from one side of the tower to the other. The pedestal robot 9 rotates as it carries the step 6 so as to reposition it near the end of the step conveyor 10. The robot 9 lowers the step to engage it with the moving step conveyor 10. At the other end of the conveyor, a second pedestal robot 9 picks up the next step having disengaged it from the conveyor 10. This robot rotates and carries the step so as to reposition it near the beginning of the set of descending escalator steps 8. The robot 9 lowers the step 2 to engage it with the drive chain 5 that is pulling the descending escalator steps 8 that are on their way down to the next lower floor. At the same time, the robot 9 on the other side of the tower has positioned itself to pick up the next step 1, thereby completing the cycle. A duplicate set of equipment to that located on the top floor of the tower is installed on the bottom floor. That is, two pedestal robots 9 and a step conveyor 10 on the bottom floor use the same technique to transfer escalator steps back from the set of descending steps 8 to the set of ascending steps 7 on the other side of the tower. Also, two counter-rotating sprocket wheels 4 on the bottom floor drive the descending and ascending steps by means of the same side bow roller drive chain 5 that is attached to the steps throughout the system.

Figure 2:
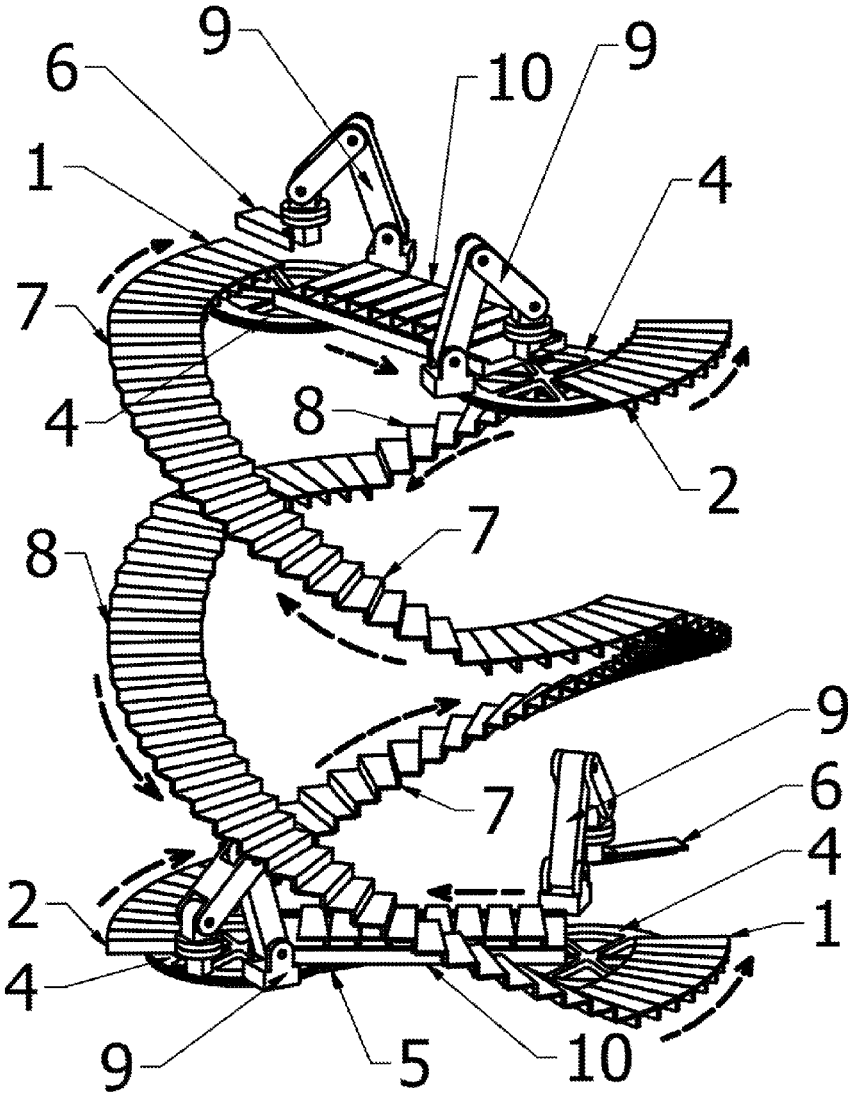
FIG. 2 is the axonometric view of the circular tower spiral escalator structure. The three floors have been omitted to make it easier to view the escalator steps, pedestal robots, step conveyors and sprocket wheels.

FIG. 2 is the axonometric view of the circular tower spiral escalator structure. The three floors have been omitted to make it easier to view the escalator steps, pedestal robots, step conveyors and sprocket wheels.

Figure 3:
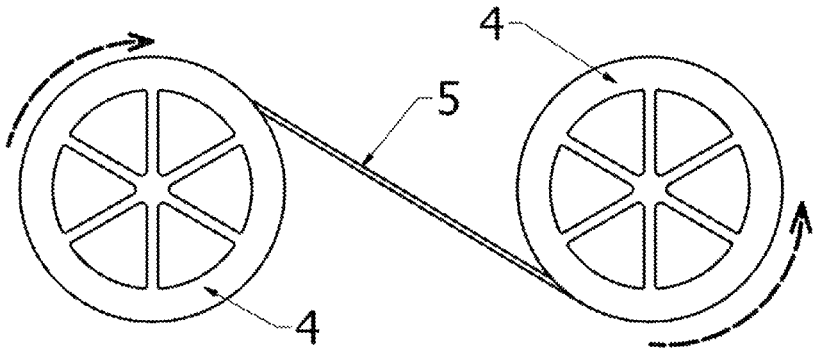
FIG. 3 shows the counter-rotating sprocket wheels and the side bow roller drive chain on the top floor.

FIG. 3 shows the counter-rotating sprocket wheels 4 and the side bow roller drive chain 5 on the top floor.

Figure 4:
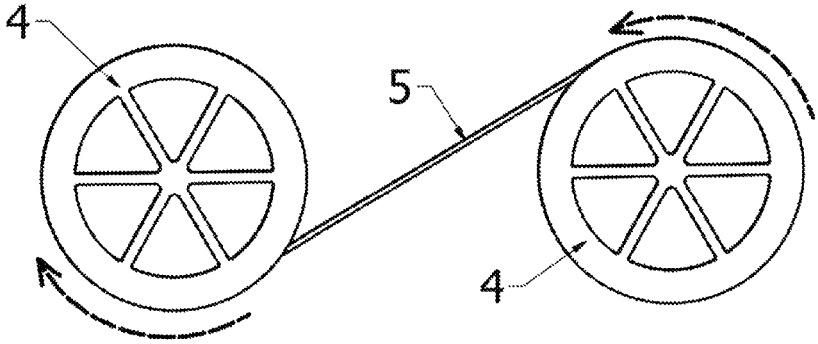
FIG. 4 shows the counter-rotating sprocket wheels and the side bow roller drive chain on the bottom floor.

FIG. 4 shows the counter-rotating sprocket wheels 4 and the side bow roller drive chain 5 on the bottom floor.

FIG. 5 shows an axonometric view on the top floor where the pedestal robot 9 on the left has just picked up a step from the top end of the set of ascending escalator steps. Call this time t=0. The step conveyor 10 shows eight steps that are moving to the right. The pedestal robot 9 on the right is moving into position for a pickup.

FIG. 6 shows an axonometric view on the top floor with both robots 9 at a later time t=3. A total of nine time intervals define the complete cycle of moving the steps. Here at t=3 the robot 9 on the left is turning a step so it will exactly fit on the conveyor 10 when it arrives at t=4. The robot 9 on the right continues to move into position to pick up a step from the right-hand end of the conveyor 10 which it will do at t=4.

FIG. 7 shows the top view of FIG. 5, time t=0.

FIG. 8 shows the top view of FIG. 6, time t=3.

FIG. 9 corresponds to FIG. 7 at time t=0 with the addition of three escalator steps on each side that are part of the moving escalator steps. These steps are moving horizontally, parallel to and in the same plane as the top floor. The three steps on the left 1 have just arrived from the floor below. The three steps on the right 2 are on the way down to the floor below.

FIG. 10 corresponds to FIG. 8 at time t=3 with the addition of the six steps described in FIG. 9.

FIG. 11 corresponds to FIG. 9 at time t=0 with the addition of more moving escalator steps on each side. The crosshatched steps 7 on the left are ascending from the floor below and those on the right 8 are descending to the floor below.

FIG. 12 corresponds to FIG. 10 at time t=3 with the addition of the ascending and descending escalator steps described in FIG. 11.

FIG. 13 shows the view on the top floor at time t=0. The left side is identical to FIG. 5 and the right side is identical to FIG. 9. This represents the beginning of the nine time intervals of the cycle that in essence moves a single step from one side of the tower to the other.

FIG. 14 shows the configuration at a later time t=1. Both robots have moved and changed their orientation. The left robot is carrying a step while the right robot is not.

FIG. 15 shows the configuration at t=2. In effect, this is the third frame of a movie depicting the activity of both robots 9 and the conveyor 10.

FIG. 16 shows the configuration at t=3, the fourth frame of the movie. The eight steps on the conveyor continue to move to the right.

FIG. 17 shows the configuration at t=4, the fifth frame of the movie. This is at the midpoint of the activity with the left robot placing a step on the left end of the conveyor while the right robot is simultaneously grabbing a step on the right end of the conveyor.

FIG. 18 shows the configuration at t=5, the sixth frame of the movie. The left robot is starting its journey back to the beginning while the right robot is in the process of carrying a step to the right side of the tower.

FIG. 19 shows the configuration at t=6, the seventh frame of the movie.

FIG. 20 shows the configuration at t=7, the eight frame of the movie.

FIG. 21 shows the configuration at t=8, the ninth frame of the movie. The right robot is placing a step on the set of descending escalator steps that are on their way down to the lower floor. The vertical riser of the step is on the leading edge of the tread, which it must be.

FIG. 22 shows the configuration at t=9, the tenth and final frame of the movie. This frame is identical to the beginning of the cycle shown in FIG. 13, the first frame of the movie.

FIG. 23 is the axonometric view of the entire circular tower spiral escalator structure depicting the alternate design of the robotic step transfer system. Counter-rotating sprocket wheels 4 on the top floor drive the ascending and descending escalator steps by means of a side bow roller drive chain 5. As ascending steps 7 arrive at the top floor, one arm of a double arm pedestal robot 3 picks up a step 1 when it arrives having thereby disengaged it from the drive chain 5. The pedestal robot rotates and repositions the step 6 on the opposite side of the tower to place it near the beginning 2 of the set of descending escalator steps 8. The robot arm lowers the step to engage it with the drive chain 5 that is pulling the descending steps 8. Meanwhile, the other arm of the double arm robot 3 has lowered and released a previous escalator step as it then rotates to move into position to pick up the next step from the set of ascending escalator steps. A duplicate set of equipment to that located on the top floor of the tower is installed on the bottom floor. That is, one arm of a double arm pedestal robot 3 on the bottom floor uses the same technique to transfer escalator steps back from the set of descending steps 8 to the set of ascending steps 7 on the other side of the tower. Also, two counter-rotating sprocket wheels 4 on the bottom floor drive the descending and ascending steps by means of the same side bow roller drive chain 5 that is attached to the steps throughout the system.

FIG. 24 is the axonometric view of the circular tower spiral escalator structure depicting the alternate design of the robotic step transfer system. The three floors have been omitted to make it easier to view the escalator steps, robots, and sprocket wheels.

FIG. 25 shows an axonometric view of the alternate design on the top floor where the robot arm on the left has just picked up a step from the left side of the tower. Call this time t=0. The robot arm on the right has an empty hand as it begins its journey to the left side.

FIG. 26 shows an axonometric view of the alternate design with the robot 3 at a later time t=3. A total of nine time intervals define the complete cycle of moving a step from one side of the tower to the other. Here at t=3 the robot arm on the backside is turning the step as it moves toward its destination on the right side of the tower. The robot arm on the front side continues to move into position to pick up a step from the left side of the tower.

FIG. 27 shows the top view of FIG. 25, time t=0.

FIG. 28 shows the top view of FIG. 26, time t=3.

FIG. 29 corresponds to FIG. 27 at time t=0 with the addition of three steps on each side that are part of the moving escalator steps. These steps are moving horizontally, parallel to and in the same plane as the top floor. The three steps on the left have just arrived from the floor below. The three on the right are on the way down to the floor below.

FIG. 30 corresponds to FIG. 28 at time t=3 with the addition of the six steps described in FIG. 29.

FIG. 31 corresponds to FIG. 29 at time t=0 with the addition of more moving escalator steps on each side. The additional steps on the left 7 are ascending from the floor below and those on the right 8 are descending to the floor below.

FIG. 32 corresponds to FIG. 30 at time t=3 with the addition of the ascending and descending escalator steps described in FIG. 31.

FIG. 33 shows the alternate design at time t=0. The drawing on the left side is identical to FIG. 25 and the drawing on the right side is identical to FIG. 29. This represents the beginning of the nine time intervals of the cycle that moves a single step from one side of the tower to the other.

FIG. 34 shows the alternate design at a later time t=1. Both arms of the robot 3 have moved and changed their orientation. The back arm is carrying a step while the front arm is not.

FIG. 35 shows the alternate design at t=2. In effect, this is the third frame of a movie depicting the activity of the robot.

FIG. 36 shows the alternate design at t=3, the fourth frame of the movie.

FIG. 37 shows the alternate design at t=4, the fifth frame of the movie. This is at the midpoint of the activity.

FIG. 38 shows the alternate design at t=5, the sixth frame of the movie.

FIG. 39 shows the alternate design at t=6, the seventh frame of the movie.

FIG. 40 shows the alternate design at t=7, the eighth frame of the movie.

FIG. 41 shows the alternate design at t=8, the ninth frame of the movie. The robot 3 is placing a step on the part of the escalator that is on its way down to the lower floor. The vertical riser of the step is on the leading edge of the tread, which it must be.

FIG. 42 shows the alternate design at t=9, the tenth and final frame of the movie. This frame is identical to the first frame at the beginning of the cycle shown in FIG. 33.

The invention claimed is:

1. A robotic step transfer system for connecting ascending and descending spiral escalator steps comprising:

a circular tower spiral escalator;

a set of ascending escalator steps that move horizontally a short distance parallel to a bottom floor of said circular tower spiral escalator, ascend to a next floor where they move horizontally, ascend eventually to a top floor where said ascending escalator steps again move horizontally;

a set of descending escalator steps that move horizontally a short distance parallel to the top floor of said circular tower spiral escalator, descend to the next floor where they move horizontally, descend eventually to the bottom floor where said descending escalator steps again move horizontally;

a side bow roller chain connecting said set of ascending escalator steps while also connecting said set of descending escalator steps;

a power drive sprocket wheel for pulling said side bow roller chain;

a counter-rotating power drive sprocket wheel that also pulls said side bow roller chain as this chain traverses parallel to the top floor of said circular tower spiral escalator;

a step conveyor on the top floor to transport said escalator steps from one side of said circular tower spiral escalator directly across to the other side;

a first pedestal robot for picking up said escalator step as it arrives at the top floor of said circular tower, lifting said escalator step having disengaged it from said side bow roller chain, rotating as said pedestal robot carries said escalator step so as to reposition it near one end of said step conveyor to engage it with moving said step conveyor;

a second pedestal robot situated at the other end of said step conveyor, lifting said escalator step having disengaged it from said step conveyor, rotating as said second pedestal robot carries said escalator step so as to reposition it near the beginning of said set of descending escalator steps, lowering said escalator step so as to engage it with said side bow roller chain that is pulling said descending escalator steps.

2. A robotic step transfer system as recited in claim 1, further comprising a duplicate step conveyor, first pedestal robot, and second robot installed on the bottom floor of said circular tower spiral escalator.

3. A robotic step transfer system as recited in claim 2, wherein the robotic step transfer system is capable of continuously transporting riders to and from a bottom floor, a plurality of floors of varying ceiling heights above the bottom floor and further to the top floor, wherein, each floor comprises level entries and exits.

4. A robotic step transfer system as recited in claim 1, further utilizing a double pedestal robot having two robot arms, in lieu of using the step conveyor, the first pedestal robot, and second pedestal robot of claim 1, wherein, one arm of the double pedestal robot picks up an escalator step of the ascending escalator steps on the top floor of one side of the circular tower spiral escalator, carrying it across to the opposite side of said circular tower and lowering the step to engage it with said side bow roller chain that is pulling said set of descending escalator steps, while the other arm of said double arm pedestal robot has lowered and released a previous escalator step as it then rotates to move into position to pick up the next step from said set of ascending escalator steps.

* * * * *